US008025541B2

(12) United States Patent
Churchill et al.

(10) Patent No.: US 8,025,541 B2
(45) Date of Patent: Sep. 27, 2011

(54) WATER SPORT TRAINING DEVICE

(76) Inventors: Robert Lee Churchill, Redlands, CA (US); Mary Louise Churchill, Redlands, CA (US)

( * ) Notice: Subject to any disclaimer, the term of this patent is extended or adjusted under 35 U.S.C. 154(b) by 260 days.

(21) Appl. No.: 12/355,615

(22) Filed: Jan. 16, 2009

(65) Prior Publication Data

US 2010/0105263 A1 Apr. 29, 2010

Related U.S. Application Data

(60) Provisional application No. 61/011,256, filed on Jan. 17, 2008.

(51) Int. Cl.
*B63B 35/58* (2006.01)

(52) U.S. Cl. ..... 441/40; 441/66; 441/132; 114/253; 114/345

(58) Field of Classification Search ..... 114/123, 114/126, 253, 345; 441/40, 65, 66, 79, 129, 441/130, 132
See application file for complete search history.

(56) References Cited

U.S. PATENT DOCUMENTS 2,334,072 A * 11/1943 Cooper ..... 114/345
2,841,805 A 7/1958 Roudebush
3,585,664 A 6/1971 Thompson
4,460,344 A * 7/1984 Notermann ..... 441/73
4,606,728 A 8/1986 Simpson
4,779,555 A * 10/1988 Hong ..... 114/345
4,865,572 A 9/1989 Andes
5,662,506 A * 9/1997 Reinhardt et al. ..... 441/40
5,713,773 A 2/1998 Churchill
6,306,000 B1 10/2001 Parten et al.
6,386,932 B1 5/2002 Murphy
7,261,607 B1 * 8/2007 Klimenko ..... 441/65

FOREIGN PATENT DOCUMENTS

WO WO 2006/068506 A1 * 6/2006

* cited by examiner

*Primary Examiner* — Stephen Avila
(74) *Attorney, Agent, or Firm* — Mind Law Firm; Justin G. Sanders; Jeromye V. Sartain

(57) ABSTRACT

A water sport training device is disclosed comprising, in one embodiment, a raft having a distal nose portion and a proximal rear portion. A relatively rigid platform is positioned within the raft and configured to provide a stable surface for the person during use of the device. A tow rope attachment means is secured to the raft for selectively towing the device over a body of water, the attachment means comprising at least one tow rope attachment point located on the nose portion of the raft, below a nose portion mid-plane. The device is configured such that a back half of the device has a center buoyancy sufficient for providing a stable surface to support the weight of a person while floating on water both at standstill and as being pulled through the water as by a boat.

24 Claims, 5 Drawing Sheets

WATER SPORT TRAINING DEVICE

RELATED APPLICATIONS

This application claims priority and is entitled to the filing date of U.S. Provisional application Ser. No. 61/011,256 filed Jan. 17, 2008, and entitled "Water Sports Training Device." The contents of the aforementioned application are incorporated by reference herein.

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to water sports, and more particularly to a water sport training device.

2. Description of Related Art

The following art defines the present state of this field:

Water sport training devices are well known in the art. For example, U.S. Pat. No. 4,460,344 to Notermann on Jul. 17, 1984 teaches such a device. Such devices are designed to make the sport of water skiing easier to learn and enjoy for water skiers. However, despite the development of many approaches to water sport training, these approaches often have significant drawbacks.

A major challenge in water skiing is keeping the two skis close together in a parallel position. One solution to this problem is to connect the two skis at a fixed distance. U.S. Pat. No. 4,460,344 to Notermann on Jul. 17, 1984 teaches such a device with a pair of skis connected together.

Another approach is to use a one piece U-shaped device that simulates the experience of two separate skis. Both U.S. Pat. No. 2,841,805 to Roudebush on Jul. 8, 1958 and U.S. Pat. No. 3,585,664 to Thompson on Sep. 5, 1969 teach such a U-shaped water ski device. These devices can require starting from the shore or from very shallow water which can be very dangerous for beginning skiers. In many lakes and streams it is against the law to start from the shore.

All of these devices provide solutions to the problem of keeping skis parallel and close together. However, similar to water skis, these hybrid devices require a relatively high minimum speed to prevent the rider from sinking. Before water planing occurs, the force of the water against the skis creates a substantial amount of resistance and requires considerable leg strength and balance in order to initiate planing. Therefore, a device is needed that makes it easier to stand in an upright position on the device before planing is initiated and not requiring the skier to start from shallow water or dry land.

One approach to make the transition from a non-moving position to a standing moving position is to provide a seat for the skier. U.S. Pat. No. 4,606,728 to Simpson on Aug. 19, 1986 teaches an inflatable seat as a water ski aid, wherein the inflatable seat does not travel with the ski, and U.S. Pat. No. 4,865,572 to Andes on Sep. 12, 1989 teaches an attached support seat for a ski but does not have an inflatable buoyant rider support. Standing on the skis is easier starting from a seated position above the water. Despite the benefit of providing a seat, neither of these devices provide any alternative solution, other than a curved front lip, to the problem of the front of the ski submerging under the water when being towed. Therefore a device is needed that reduces the tendency of a towed object being pulled underwater.

As mentioned, another challenge in water-skiing is keeping the nose of the ski from diving under the water. This is also true for water sport devices that can be towed without a person on the device. Such devices are usually designed with the front edge extending upwards to avoid the front diving into the water. U.S. Pat. No. 6,386,932 to Murphy on May 14, 2002 teaches a hydrofoil water sport device that uses inflatable pontoons on each side of the hydrofoil, in addition to having a front edge extending upwards. The inflatable pontoons give the hydrofoil device additional buoyancy that reduces the tendency of the device to dive into the water when being towed. The pontoons must be enlarged in such a device to achieve sufficient buoyancy. However, despite features to reduce dive tendency of a device when towed without a rider, the Murphy device teaches and requires a user to manually hold the tow rope attached directly to the boat. As such, the device cannot be towed without a rider or when capsized. The device does not have an inflatable or substantially buoyant center seat which is preferable to support and stabilize the rider and allow the device to be towed by the boat. With the tow rope in the skier's hands, the skier will feel the full force of the boat pulling the tow rope, which requires a great deal of upper body strength and coordination to hold on. Therefore a water-skiing training device is needed that does not require the skier to directly hold the tow rope being pulled by the boat, while it also provides for a reduced tendency to dive when the device is either upright or capsized.

U.S. Pat. No. 6,306,000 to Parten et al. on Oct. 23, 2001 teaches the use of a training platform designed to be attached to the boat. This towing system attempts to reduce the breakage that is inherent from the present tow systems which attach the tow rope to the water planing devices. However, breakage is not significantly reduced with such a device because the tow system does not substantially reduce the diving inherent from ski platforms and because the tow rope is attached directly to the training platform, creating stress points on the platform. Therefore, a water-skiing training device is needed that provides for reduced diving tendency when being towed and that provides a more efficient attachment means that does not attach directly to the training platform.

U.S. Pat. No. 5,713,773 to Churchill on Feb. 3, 1998 teaches an inflatable water sport device with seat and handles not attached directly to the main tow rope. The problem of direct force on the rider from the tow rope is alleviated by connecting the tow rope to the front of the vehicle and having two handles attached to the front of the device for the rider to hold for stability without requiring a great deal of upper body strength. However, because of the fixed location of the handles of the Churchill device, no adjustment can be made for the height of the rider as the rider moves from a seated position to a standing position. Also the device does not provide for a rigid or semi-rigid floor upon which a skier may stand because the device is only an inflatable and does not provide the stability necessary for standing. Therefore a water-skiing training device is needed that provides a handle that can adjust with the skier as the skier stands, and a rigid or semi-rigid floor, as well as a bottom planing surface area that replicates the parallel position of water skis. It would be desirable to provide an inflatable water ski training device that is capable of planing at low speeds and maintaining structural rigidity to allow for low speed towing. It would also be desirable to provide an inflatable water ski training device that is capable of being towed when in either an upright or capsized position.

As the prior art shows, a variety of water sport training devices already exists. A popular training device is the one-piece U-shaped ski. Even though the U-shaped ski can be difficult to use for young and new skiers and may require shore starts and assistance to hold the skier above water, this device is a good intermediate training device before attempting to ski on traditional water skis. However, it can become expensive to buy multiple water sport training devices. Preferably, a needed training device would use the popular U-shaped platform, while also accommodating the needs of more advanced skiers. Therefore a water sport training device is needed that can incorporate a wide variety of existing water sport training platform shapes.

Thus, there is a need for a water sport training device that solves the problem of keeping skis together in a parallel position as well as provide a seat to make it easier to stand in an upright position on the device. The needed invention would provide beginners the advantage of starting from a dry out-of-the-water seated position. The needed invention would also include inflatable stability bladders to reduce the tendency of a towed object being pulled underwater while either upright or capsized. Such a needed device would further avoid having the skier directly hold the tow rope being pulled by the boat, but still provide a handle that can adjust with the skier as the skier stands. Additionally, the needed invention may incorporate existing water sport training platform shapes made of wood or other materials. The needed invention would further provide the stability from the combined inflatable bladder with the rigid or semi-rigid platform necessary to train water skiers in basic maneuvers.

Aspects of the present invention fulfill these needs and provide further related advantages as described in the following summary.

SUMMARY OF THE INVENTION

Aspects of the present invention teach certain benefits in construction and use which give rise to the exemplary advantages described below.

The sport of towing a rider on a water-planing device behind a boat is well known. The types of devices may generally be divided into the categories of water skis, water planes, aquaplanes, and inflatables. Water skis have the advantages of control and versatility. However, water skiing requires a development of sufficient strength to hold onto a tow rope while maintaining the skis in a parallel relationship and standing erect while doing both. This makes water skiing a difficult and often frustrating sport for the beginner, requiring the simultaneous development and use of arm strength, leg strength and balance.

When water skiing, a skier can find it difficult to maintain balance when being pulled from a floating starting position, in which the skier and skis are partially submerged, to the skiing position, in which the skis ride on the water surface. Moreover, when the skier is pulled from the submerged starting position, the pulling force from the tow rope tends to pull the arms and upper body of the skier in one direction, while the skis are pushed by the water in the opposite direction. This causes considerable problems for beginners and intermediate skiers, and can even be difficult for proficient skiers.

It would be desirable to provide a water ski training device for towing behind a boat or the like which may be used by beginners or accomplished skiers, by providing the stability needed by beginners as well as adjustability for skill level for increasing the challenge and controllability for advanced skiers. It is to such a device that the present invention is directed.

The present device is a water sport training device for supporting the weight of a person floating on water both at standstill and as being pulled through the water as by a boat. In one embodiment, the device comprises a raft having a distal nose portion and a proximal rear portion. A relatively rigid platform is positioned within the raft and configured to provide a stable surface for the person during use of the device. A tow rope attachment means is secured to the raft for selectively towing the device over a body of water, the attachment means comprising at least one tow rope attachment point located on the nose portion of the raft, below a nose portion mid-plane. The device is configured such that a back half of the device has a center buoyancy sufficient for providing a stable surface to support the weight of a person both while in motion and at rest.

Thus, the present invention solves the problem of keeping skis together in a parallel position for new skiers, makes it easier to stand in an upright position on the device, and reduces the tendency of a towed object diving underwater. The present invention provides floatation and stability to train skiers in all basic maneuvers. The buoyancy of the present invention allows the rider to float and start from a dry out-of-the-water seated position. Furthermore, the present device avoids the difficulty of the skier holding the tow rope connected to the boat and instead provides a handle attached directly to the raft that can adjust to the height of the skier as the skier stands. Additionally, the present invention may incorporate existing water sport training platforms, such as a wood, plastic, or fiberglass shaped ski trainer, a foam body board, and/or water skis.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
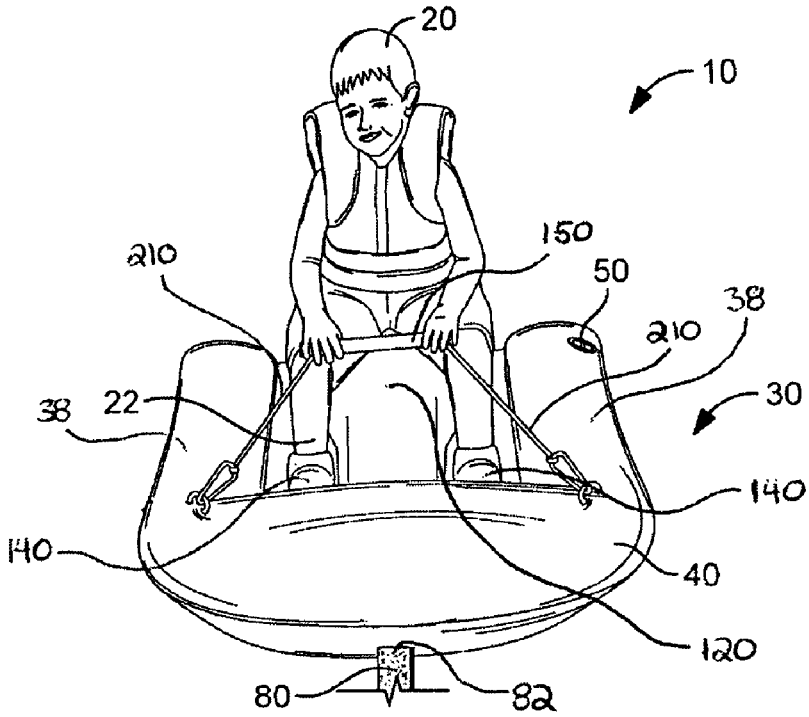
FIG. 1 is a perspective view of an exemplary embodiment of the invention with a person in a seated position floating or being towed.

With respect to the drawings, FIG. 1 illustrates a first exemplary embodiment of a water sport training device 10 for supporting the weight of a person 20 floating on water 12 both at standstill and as being pulled through the water 12 as by a boat (not shown). The device 10 includes a buoyant raft 30 having a distal nose portion 42 and a proximal rear portion 44. In the preferred embodiment, the nose portion 42 and rear portion 44 are an inflatable bladder 40. In alternate embodiments, the nose portion 42 and rear portion 44 are made of foam, molded plastic, or any other material or method of manufacture, now known or later developed, having sufficiently buoyant properties. For the purposes of this disclosure, bladder 40 will be used to illustrate and describe the present invention.

Figure 4:
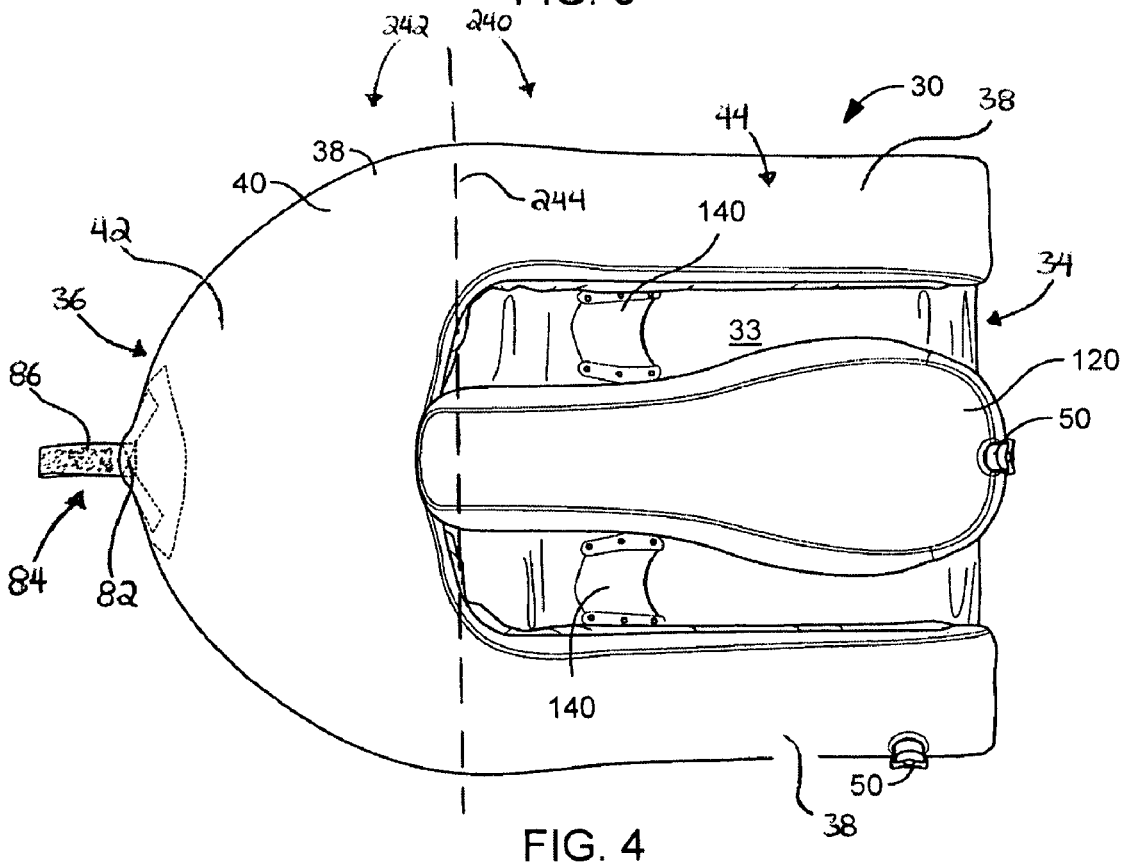
FIG. 4 is a top plan view thereof.
Figure 5:
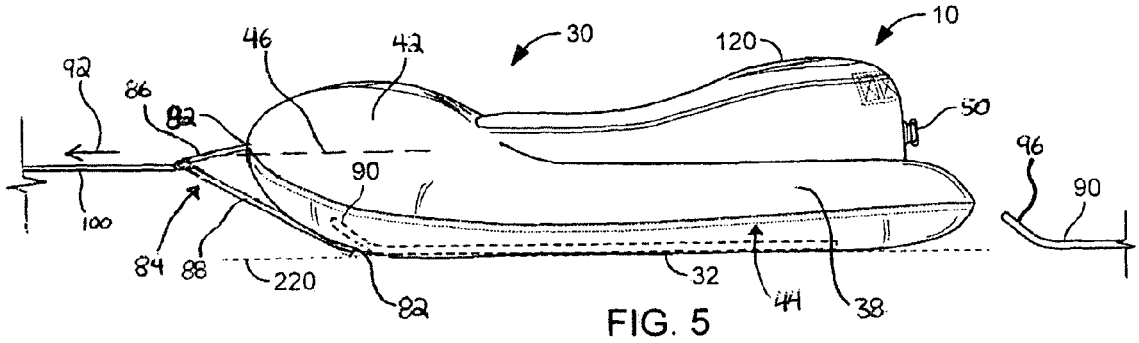
FIG. 5 is a partial exploded view thereof, showing the platform outside the raft and in phantom outline the approximate position of the platform within the platform pocket.
Figure 7:
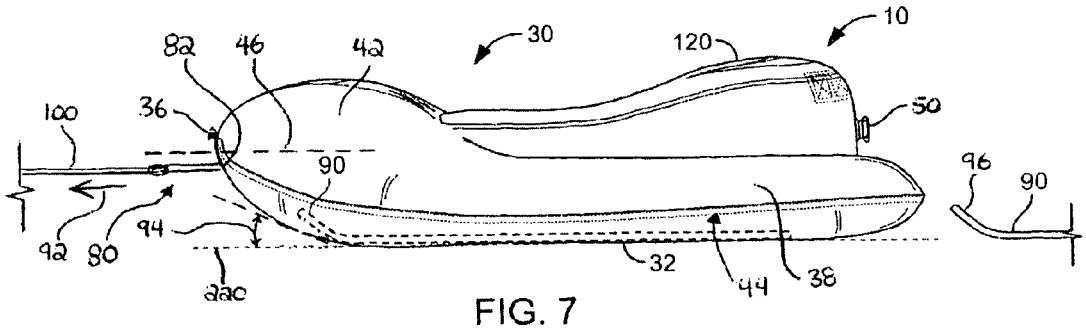
FIG. 7 is a partial exploded view of an alternate embodiment of the invention, showing the platform outside the raft and in phantom outline the approximate position of the platform within the platform pocket.

The bladder 40 includes at least one inflation valve 50 (FIG. 1) through which a gas (not shown), such as air, may be selectively introduced into the bladder 40. The raft 30 and bladder 40 are preferably made from a lightweight, durable, flexible, waterproof material such as a rubber or vinyl material, but may also be formed from any suitable durable material, now known or later developed, such as a durable flexible plastic material. The raft 30 may further be covered with nylon or other fabrics. In a preferred embodiment, the inflatable bladder 40 is U-shaped in plan view (FIG. 4), and the rear portion provides a pair of buoyant lateral pontoons 38. As shown in FIG. 5, the nose portion 42 defines a nose portion mid-plane 46 substantially midway through a horizontal thickness of the nose portion 42. In alternate embodiments not shown, the bladder 40 can also be V-shaped or O-shaped in plan view. In the preferred embodiment, as best shown in FIG. 7, the nose portion 42 is curved in an upwardly directed with respect to the rear portion 44, such that it creates an acute angle 94 with an imaginary plane 220 of a bottom surface 32 of the raft 30. This prevents the nose portion 42 from submerging under the water 12 when the device 10 is being towed, regardless of whether there is a person 20 on the device 10.

As best shown in FIG. 5, a relatively rigid platform 90 is positioned within the raft 30, proximal to the nose portion 42. The platform 90 is configured to provide a stable surface for the person 20 during use of the device 10. Further details regarding the platform 90 are discussed below.

Figure 3:
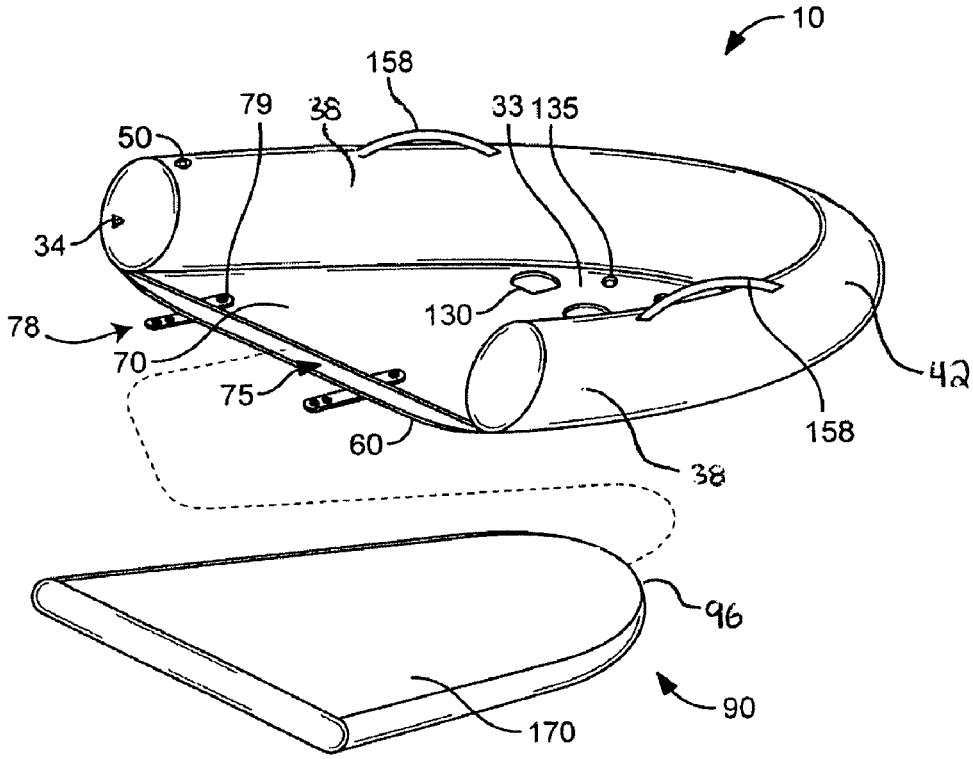
FIG. 3 is a perspective view illustrating the removable insertion of a platform into a platform pocket of an exemplary embodiment of the invention.

In the preferred embodiment, as shown in FIGS. 3 and 5, a first web 60 spans a perimeter of the raft 30, defining the bottom surface 32 of the raft 30. In FIGS. 3 and 4, a second web 70 also spans the raft 30, offset from the first web 60, defining a top surface 33 of the raft 30. The first web 60 and second web 70 cooperate to define a platform pocket 75 having a selectively closable pocket aperture 76, sized and configured to removably receive the platform 90, and preferably positioned at a rear side 34 of the raft 30, illustrated in FIG. 3. The pocket aperture 76 is selectively closable using an aperture closure means 78. Preferably, the aperture closure means 78 are zippers (not shown). Alternately, the aperture closure means 78 are mechanical snaps 79 attached to the first web 60 and second web 70. Other aperture closure means 78 include hook-and-loop type fasteners, snaps, tabs that can be tied together (not shown), or any other closure means now known or later developed. FIG. 3 illustrates a relatively rigid platform 90 removably insertable into the platform pocket 75 via the pocket aperture 76. This allows the person 20 to selectively change the type of platform 90 to use with the device, creating a much more versatile and marketable product. In a still further embodiment, the pocket aperture 76 is permanently sealed, such as by sewing, thermal welding or any other method now known or later developed, once the platform 90 has been inserted into the platform pocket 75.

Figure 8:
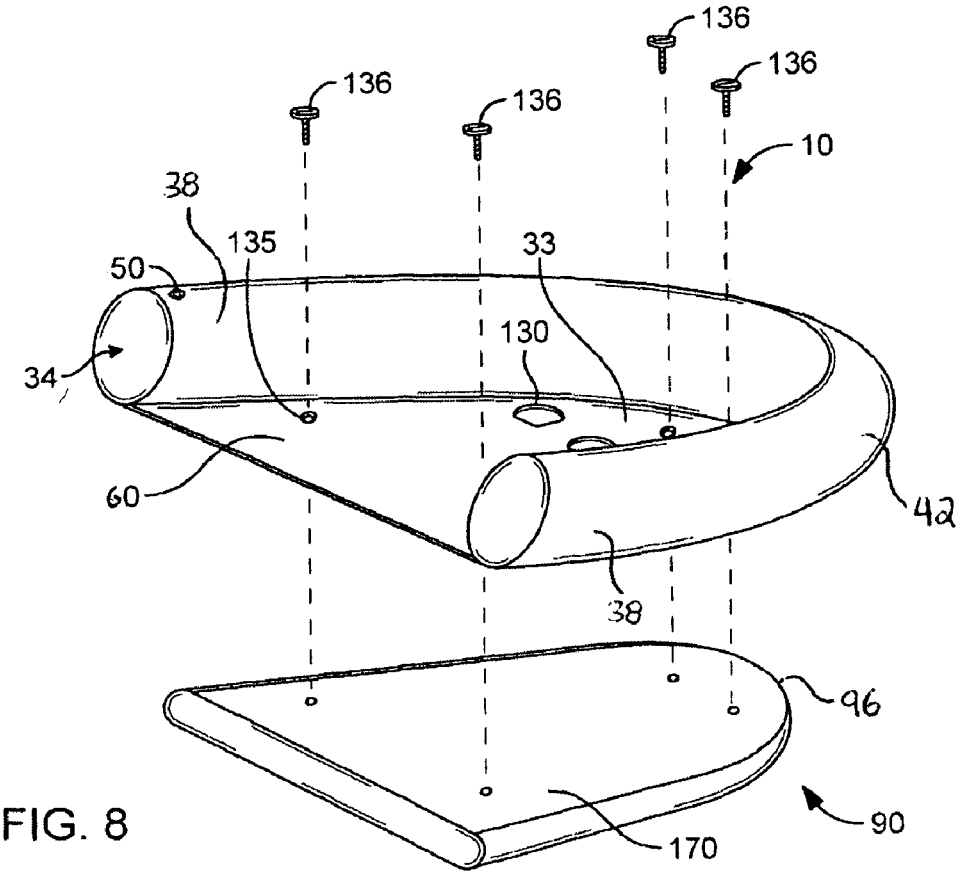
FIG. 8 is an exploded view of one embodiment of the invention.
Figure 9:
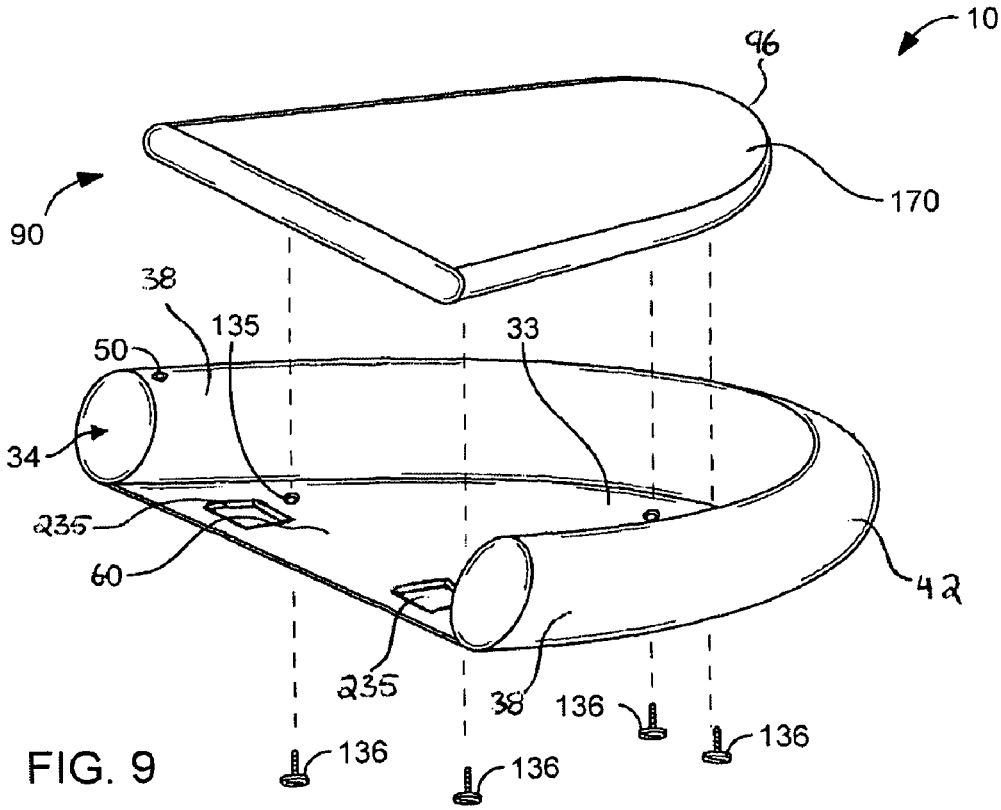
FIG. 9 is an exploded view of another embodiment of the invention.

In alternate embodiments, shown in FIGS. 8 and 9, the first web 60 defines both bottom surface 32 and top surface 33 of the raft 30. The platform 90 is permanently or removably secured to the bottom surface 32 (FIG. 8) or top surface 33 (FIG. 9) using glue, lamination, mechanical fasteners or any other means for affixing the platform 90 to the bottom or top surfaces 32 and 33, now known or later developed. In one alternate embodiment, as shown in FIGS. 8 and 9, the first web 70 defines a plurality of fastener apertures 135 through which mechanical fasteners, such as plastic screws 136, may be inserted and secured to the platform 90, either from above (FIG. 8) or from below (FIG. 9).

Figure 2:
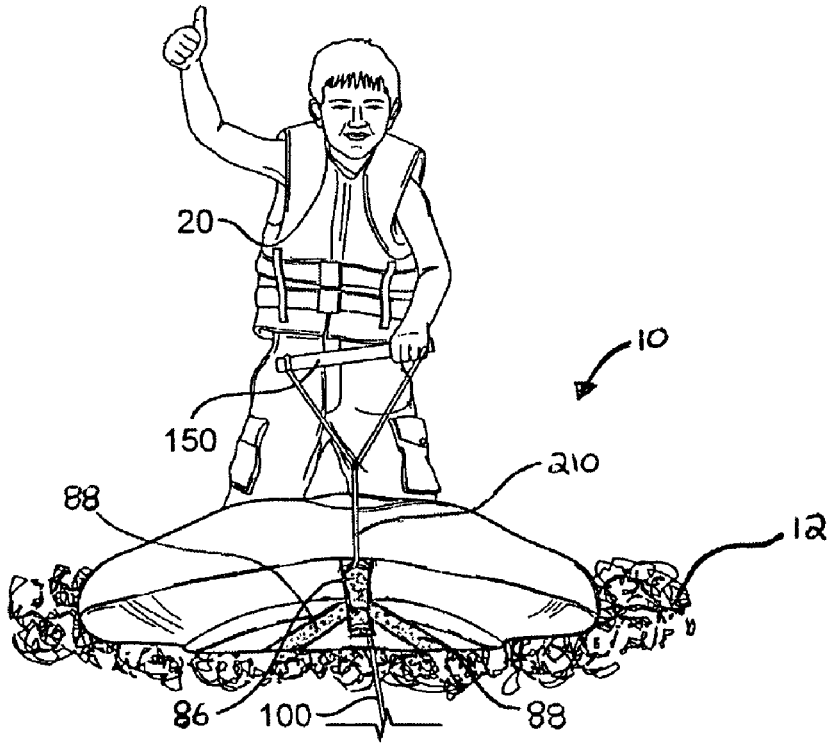
FIG. 2 is a perspective view thereof, with a person in a standing position.

In FIGS. 2 and 5, a tow rope attachment means 80 is secured to the raft 30 for selectively towing the device 10, via a removably engageable tow rope 100, over the water 12, whereby the person 20 is supported by the platform 90 and the raft 30. In one embodiment, the tow rope attachment means 80 comprises at least one tow rope attachment point 82 located on the nose portion 42 below the nose portion mid-plane 46, as shown in FIG. 7. In another embodiment, shown best in FIG. 5, the tow rope attachment means 80 is a strap assembly 84 comprising an at least one elongate upper strap portion 86, engaged proximally with the nose portion 42 of the raft 30 and distally with an at least one elongate lower strap portion 88, the lower strap portion 88 engaged proximally with the nose portion 42 below the nose portion mid-plane 46. As illustrated in FIG. 5, each of the at least one lower strap portions 88 is at least twice as long as each of the at least one upper strap portions 86. Preferably, the strap assembly 84 comprises one upper strap portion 86 and two lower strap portions 88, forming a tripod-like engagement with the nose portion 42 when the device 10 is being towed. With the tow rope attachment means 80 secured to the raft 30 as described above, the direction of pull force 92 applied to the tow rope attachment means 80, during use of the device 10, is substantially parallel with and below the nose portion mid-plane 46. Thus, the nose portion 42 will tend to not submerge when the device 10 is in use, nor will the device 10 be able to lift up out of the water 12, due to the angle and direction of the pull force 92 in combination with the location of the tow rope attachment means 80. It should also be noted that having the tow rope attachment means 80 secured to the nose portion 42, rather than directly to the rigid platform 90, ensures that the platform 90 will not be caused to break due to the tensions of being pulled through the water 12 and possibly submerged while the device 10 is in use, since these tensions will be acting upon the resilient nose portion 42 instead. This benefit is a great improvement over the cited prior art.

In preferred embodiment, as best shown in FIGS. 1 and 2, a handle 150 is interconnected with the device 10, either permanently or removably, by an at least one handle rope 210. The handle 150 is configured to allow the person 20 to selectively support himself in a standing position (FIG. 2) on the platform 90 while being towed across the water 12. In one embodiment, the handle 150 is connected directly to the raft 30 (FIG. 1). In another embodiment, the handle 150 is connected to the tow rope attachment means 80 (FIG. 2). In yet another embodiment, the handle 150 is connected directly to the tow rope 100 (not shown). The means by which the handle 150 is connected to the device 10 may include any material or method now known or later developed, such as stitching, knotting, mechanical fasters or glue. In one embodiment, an at least one hand hold 158 (FIG. 3) is engaged with the raft 30 and configured for assisting the person 20 in holding on while the device 10 is in use.

In one embodiment illustrated best in FIGS. 4 and 5, the raft 30 includes a buoyant seat portion 120 positioned substantially on a back half 240 of the device 10, adjacent to the platform 90. It should be noted, as best shown in FIG. 4, for the purpose of accurately describing the present invention, a front half 242 of the device 10 is the portion of device 10 distal to imaginary line 244, and the back half 240 of the device 10 is the portion of the device 10 proximal to imaginary line 244. In the preferred embodiment, the seat portion 120 is an inflatable bladder, having an inflation valve 50, similar to the bladder 40. In alternate embodiments, the seat portion 120 is made of foam, molded plastic, or any other material or method of manufacture, now known or later developed, having sufficiently buoyant properties. During use of the device 10, the person 20 is able to straddle the seat portion 120 while the person's feet 22 are supported by the platform 90 on either side of the seat portion 120, as shown in FIG. 1. The seat portion 120 thus makes it easier for the person 20 to transition into a standing skiing position, as shown in FIG. 2.

Figure 6:
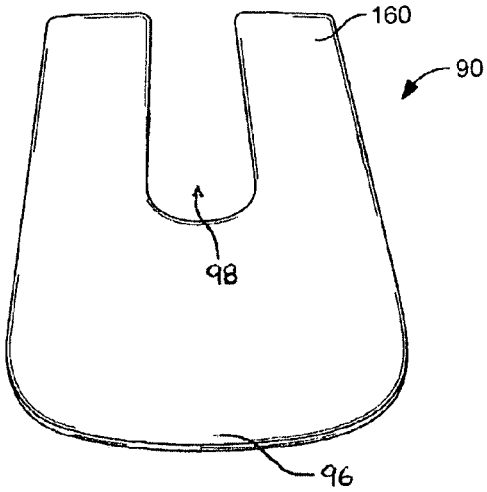
FIG. 6 is a perspective view of a platform of one embodiment of the invention.

In an embodiment illustrated in FIGS. 3 and 6, the second web 70 further defines a pair of foot binding apertures 130 through which a pair of foot bindings 140 of the platform 90 may extend upwardly from top surface 33. In an alternate embodiment, shown in FIG. 8, the first web 60 defines the foot binding apertures 130 through which the foot bindings 140 of the platform 90 may extend. The foot bindings 140 are configured to securely receive the person's feet 22, giving the person 20 better stability while using the device 10. Alternately, the foot bindings 140 may be removably mounted directly to the platform 90 through the second web 70 (FIG. 4).

Figure 10:
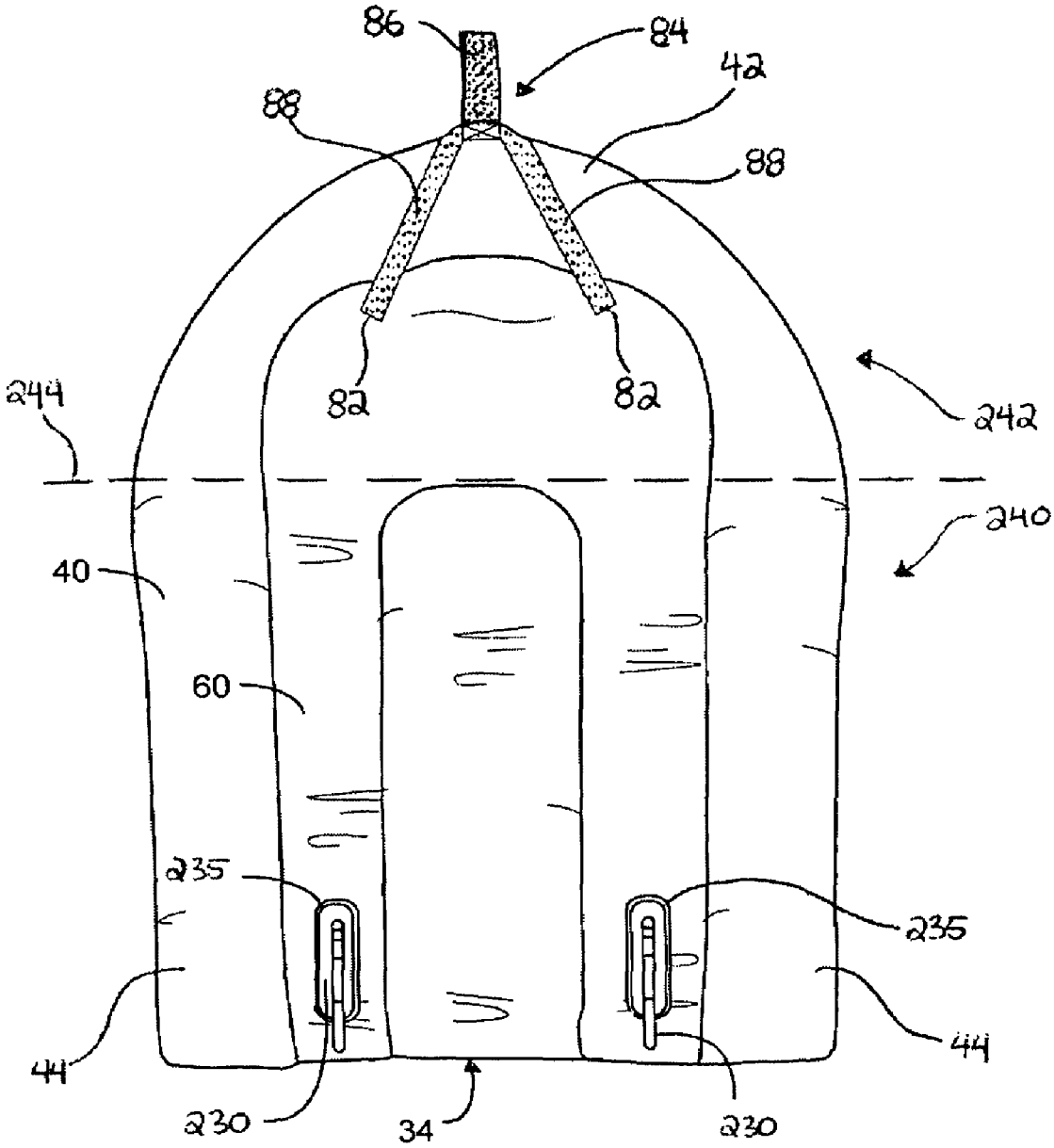
FIG. 10 is a bottom plan view of an exemplary embodiment of the invention.

In an embodiment illustrated in FIGS. 9 and 10, the first web 60 defines an at least one fin aperture 235 through which an at least one fin 230 of the platform 90 may extend downwardly from bottom surface 32. The fins 230 are configured to assist in directional movement of the device 10 when the device 10 is in use. Alternately, the fins 230 may be removably mounted directly to the platform 90 through the first web 60.

In a preferred embodiment, the platform 90 is a rigid U-shaped ski training board 160, as best shown in FIG. 6. In another embodiment, best shown in FIG. 3, the platform 90 is a pliable foam body board 170. FIG. 5 illustrates yet another embodiment with a platform nose 96 of the platform 90 curving in an upwardly direction similar to the nose portion 42, thereby further preventing the nose portion 42 from submerging under the water 12 when the device 10 is being towed. It should be noted that in other embodiments, the platform 90 may be water skis, a kneeboard, a wakeboard, or any other type of water sport board now known or later developed. Additionally, the platform 90 may be made of other types of materials or methods of manufacture now known or later developed, such as foam, plywood or fiberglass.

Due to the buoyant properties of the raft 30, as discussed above, the raft 30 has sufficient perimeter buoyancy to support the weight of the person 20 without submerging. The term "buoyancy" as used in this application is intended to mean the weight of the volume of water 12 displaced by the device 10, or a portion thereof, with respect to the weight of the person 20 using the device 10. As best shown in FIGS. 4 and 5, the back half 240 of the raft 30 further provides sufficient center buoyancy, meaning that the device 10 has a sufficient amount of buoyancy near the center of the raft 30 such that while the platform 90 may become submerged in the water 12 when the device 10 is at rest, the person 20 will remain substantially out of the water. This center buoyancy also further stabilizes the platform 90, allowing the person 20 to stand and sit more easily, with relatively greater balance and stability, when the device 10 is in use or at rest. Preferably, the back half 240 has a center buoyancy, as measured by the weight of the volume of water 12 displaced thereby, of greater than at least fifty percent of the weight of the person 20.

In one embodiment, the rear portion 44 is configured for providing the entire center buoyancy of the back half 240. In another embodiment, the rear portion 44 and seat portion 120 are configured for providing the entire center buoyancy of the back half 240 in combination. Additionally, the platform 90 is preferably U-shaped, defining a cutout portion 98 (FIG. 6) sized and configured for allowing the seat portion 120 to be positioned partially within the cutout portion 98 and float on the water 12 during use of the device, thereby providing an even greater center buoyancy. In a further embodiment, the platform 90 is of buoyant construction, using materials such as foam or the like, and is configured for providing the entire center buoyancy of the back half 240 in combination with the rear portion 44 and/or seat portion 120. It should be noted that other buoyant materials now known or later developed, such as molded plastic, may be substituted.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A water sport training device for supporting the weight of a person floating on water both at standstill and as being pulled through the water as by a boat, the device comprising:

a substantially U-shaped raft having a distal nose portion and a proximal rear portion, the nose portion defining a nose portion mid-plane substantially midway through a horizontal thickness of the nose portion;

the rear portion comprising a pair of spaced apart, substantially parallel lateral pontoons;

a relatively rigid platform positioned within the raft and configured for providing a substantially stable surface for the person during use of the device; and a tow rope attachment means secured to the raft for selectively towing the device over a body of water, the attachment means comprising at least one tow rope attachment point located on the nose portion below the nose portion mid-plane;

whereby the rear portion and platform are configured for allowing water that ma enter the raft during use to freely exit the raft proximal a rear side thereof, such that a back half of the device is capable of substantially maintaining a center buoyancy, as measured by the weight of the volume of water displaced thereby, of greater than at least fifty percent of the weight of the person.

2. The water sport training device of claim 1, further comprising a buoyant seat portion positioned substantially on the back half of the device between the pontoons and adjacent to the platform.

3. The water sport training device of claim 1, wherein the platform is of buoyant construction.

4. The water sport training device of claim 1, wherein the rear portion is configured for providing the entire center buoyancy of the back half of the device.

5. The water sport training device of claim 2, wherein the rear portion and seat portion are configured for providing the entire center buoyancy of the back half of the device.

6. The water sport training device of claim 3, wherein the rear portion and platform are configured for providing the entire center buoyancy of the back half of the device.

7. The water sport training device of claim 2, wherein the rear portion, seat portion and platform are configured for providing the entire center buoyancy of the back half of the device.

8. The water sport training device of claim 2, wherein the platform defines a cutout portion sized and configured for allowing the seat portion to float on the water during use of the device.

9. The water sport training device of claim 1, further comprising a first web spanning a perimeter of the raft, the platform being installed adjacent the first web.

10. The water sport training device of claim 9 wherein the platform is permanently secured to the first web.

11. The water sport training device of claim 9 further comprising a second web spanning the perimeter of the raft offset from the first web, the first and second webs cooperating to define a platform pocket therebetween for removable receipt of the platform.

12. The water sport training device of claim 11 further comprising removable foot bindings attached to the platform through the first web.

13. The water sport training device of claim 11 further comprising an at least one removable fin attached to the platform through the second web.

14. The water sport training device of claim 1, wherein the nose and rear portions of the raft are an inflatable bladder.

15. The water sport training device of claim 1, wherein the tow rope attachment means is a strap assembly comprising:

an at least one elongate upper strap portion, engaged proximally with the nose portion of the raft and distally with an at least one elongate lower strap portion, the lower strap portion engaged proximally with the nose portion below the nose portion mid-plane, whereby, during use of the device, the direction of pull force applied to the strap assembly is substantially parallel with and below the nose portion mid-plane.

16. The water sport training device of claim 15, wherein the at least one lower strap portion is at least twice as long as the at least one upper strap portion.

17. A water sport training device for supporting the weight of a person floating on water both at standstill and as being pulled through the water as by a boat, the device comprising:

a substantially U-shaped raft having a distal nose portion and a proximal rear portion, the rear portion comprising a pair of spaced apart, substantially parallel lateral pontoons;

a relatively rigid platform removably engaged with the raft and configured for providing a substantially stable surface for the person during use of the device;

a buoyant seat portion positioned substantially on a back half of the device between the pontoons and adjacent to the platform, the seat portion configured for at least partially contributing to a center buoyancy of the back half of the device, as measured by the weight of the volume of water displaced thereby; and a tow rope attachment means secured to the raft for selectively towing the device over a body of water, the attachment means comprising at least one tow rope attachment point located on the nose portion;

whereby the rear portion and platform are configured for allowing water that may enter the raft during use to freely exit the raft proximal a rear side thereof, such that the back half of the device is capable of substantially maintaining a center buoyancy of greater than at least fifty percent of the weight of the person.

18. A water sport training device for supporting the weight of a person floating on water both at standstill and as being pulled through the water as by a boat, the device comprising:

a raft having a distal nose portion and a proximal rear portion, the nose portion defining a nose portion mid-plane substantially midway through a horizontal thickness of the nose portion;

a seat portion positioned substantially on a back half of the device, wherein the back half of the device has a center buoyancy, as measured by the weight of the volume of water displaced thereby, of greater than at least fifty percent of the weight of the person supported by the device, and further wherein at least the rear portion and seat portion are configured for providing the entire center buoyancy of the back half of the device;

a strap assembly having an at least one elongate upper strap portion, engaged proximally with the nose portion of the raft and distally with an at least one elongate lower strap portion, the at least one lower strap portion engaged proximally with the nose portion below the nose portion mid-plane;

the at least one lower strap portion being at least twice as long as the at least one upper strap portion; and a first web installed proximal the seat portion and configured to provide an upper surface on which the person may stand.

19. The water sport training device of claim 1, wherein the platform is at least one water ski.

20. The water sport training device of claim 2, wherein the seat portion is configured for providing the entire center buoyancy of the back half of the device.

21. The water sport training device of claim 2, wherein the seat portion and platform are configured for providing the entire center buoyancy of the back half of the device.

22. The water sport training device of claim 1, wherein the platform is a wakeboard.

23. A water sport training device for supporting the weight of a person floating on water both at standstill and as being pulled through the water as by a boat, the device comprising:

a substantially U-shaped raft having a distal nose portion and a proximal rear portion, the rear portion comprising a pair of spaced apart, substantially parallel lateral pontoons;

a first web spanning a perimeter of the raft;

a second web spanning the perimeter of the raft, offset from the first web, the first and second webs cooperating to define a platform pocket therebetween;

a buoyant seat portion positioned substantially on a back half of the device between the pontoons and adjacent to the first and second webs, the seat portion configured for at least partially contributing to a center buoyancy of the back half of the device, as measured by the weight of the volume of water displaced thereby; and a relatively rigid platform selectively positionable within the platform pocket and configured for providing provide a substantially stable surface for the person during use of the device, the platform defining a cutout portion sized and configured for allowing the seat portion to float on the water during use of the device;

whereby the device is configured for allowing water that may enter the raft during use to freely exit the raft proximal a rear side thereof, such that the back half of the device is capable of substantially maintaining a center buoyancy of greater than at least fifty percent of the weight of the person.

24. A water sport training device for supporting the weight of a person floating on water both at standstill and as being pulled through the water as by a boat, the device comprising:

a raft having a distal nose portion and a proximal rear portion, wherein a back half of the device has a center buoyancy, as measured by the weight of the volume of water displaced thereby, of greater than at least fifty percent of the weight of the person supported by the device, and further wherein at least the rear portion is configured for providing the entire center buoyancy of the back half of the device;

a tow rope attachment means secured to the raft for selectively towing the device over a body of water, the attachment means comprising at least one tow rope attachment point located on the nose portion; and a first web installed within the raft, spanning a perimeter thereof, and configured to be selectively operable with a removably engagable, relatively rigid platform capable of providing a substantially stable surface for the person during use of the device, the platform being selected from one of a substantially U-shaped ski training board, a body board, an at least one water ski, a kneeboard, a wakeboard, and a surfboard.

* * * * *